United States Patent [19]

Burdette et al.

[11] 4,398,978

[45] Aug. 16, 1983

[54] HIGH DENSITY, LOW VISCOSITY AIRBREATHER FUEL (RJ-4-I)

[75] Inventors: George W. Burdette, Ridgecrest, Calif.; Abraham I. Schneider, Philadelphia, Pa.

[73] Assignee: The United States of America as represented by the Secretary of the Navy, Washington, D.C.

[21] Appl. No.: 371,869

[22] Filed: Apr. 26, 1982

[51] Int. Cl.[3] ..... D03D 23/00; D03D 43/00

[52] U.S. Cl. ..... 149/109.6; 149/109.4; 585/253; 585/360

[58] Field of Search ..... 585/360, 253; 149/109.4, 109.6, 87

[56] References Cited

U.S. PATENT DOCUMENTS

| | | | |
|---|---|---|---|
| 2,999,890 | 9/1961 | Davison | 585/253 |
| 3,233,001 | 2/1966 | Merryfield | 585/253 |
| 3,244,756 | 4/1966 | Cabbage | 585/253 |
| 3,381,046 | 4/1968 | Cohen et al. | 260/666 |
| 3,489,733 | 1/1970 | Natta | 585/360 X |
| 4,017,552 | 4/1977 | Menapace | 585/360 |
| 4,059,644 | 11/1977 | Cannell | 260/666 PY |
| 4,086,284 | 4/1978 | Schneider et al. | 260/666 PY |
| 4,086,286 | 4/1978 | Janoski et al. | 260/666 PY |
| 4,107,223 | 8/1978 | Schneider et al. | 260/666 PY |
| 4,138,441 | 2/1979 | Kennedy | 585/360 X |
| 4,177,217 | 12/1979 | Janoski et al. | 585/253 |
| 4,207,080 | 6/1980 | Suld | 149/109.4X |
| 4,222,800 | 9/1980 | Myers, Jr. et al. | 149/109.6 |
| 4,225,735 | 10/1980 | Hall, Jr. | 149/109.4 X |
| 4,288,644 | 9/1981 | Janoski et al. | 585/360 |
| 4,367,351 | 1/1983 | Fisher | 149/109.4 X |

FOREIGN PATENT DOCUMENTS

| | | | |
|---|---|---|---|
| 1190459 | 2/1962 | Fed. Rep. of Germany | 585/360 |
| 1123320 | 12/1966 | United Kingdom | 585/360 |

*Primary Examiner*—Stephen J. Lechert, Jr.
*Assistant Examiner*—Catherine S. Kilby
*Attorney, Agent, or Firm*—R. F. Beers; W. T. Skeer

[57] ABSTRACT

A method for preparation of high density, high energy, low viscosity liquid hydrocarbon fuel by catalytic treatment of tetrahydrodimethyldicyclopentadiene (RJ-4) synthetic fuel. Endo-isomers within the fuel stock are isomerized to exo-isomers by treatment of the fuel stock with catalysts such as aluminum chloride, nickel, or pulverized, acid treated firebrick resulting in a fuel having a lower viscosity than the original RJ-4.

7 Claims, No Drawings

HIGH DENSITY, LOW VISCOSITY AIRBREATHER FUEL (RJ-4-I)

BACKGROUND OF THE INVENTION

1. Field of the Invention

This invention relates to the preparation of synthetic fuels. More particularly this invention relates to the preparation of high density, high energy, low viscosity liquid hydrocarbon fuel for use in jet or rocket propulsion of missiles or aircraft. Still more particularly this invention relates to the conversion of endo-isomers within RJ-4 fuel stock to exo-isomers by contacting said fuel stock with a catalyst at room temperature thus resulting in a lower freezing-lower viscosity fuel.

2. Description of the Prior Art

High energy, high density liquid fuels are particularly demanded in aircraft and missile applications where fuel carrying capacity is very limited. They are useful in both jet propulsion systems such as ramjet, turbo-jet and pulse jet, and in rockets, i.e., devices containing their own oxygen or oxidizing agent. Missile applications are particularly stringent since no refueling can be accomplished. Range is thus dependent upon internal fuel supplies.

Requirements of extended range for air launched missiles while retaining overall dimensions of previous missiles to allow launch from existing aircraft stations has led to the proposal to add ramjet propulsion to previously all solid rocket propulsion in the missile system. Also the introduction of long range subsonic cruise missiles has made extended range a critical operational parameter. High energy, high density liquid hydrocarbon fuels have been proposed and employed in such systems.

High energy, high density fuels suitable for use must exhibit properties such as high volumetric heating value, low viscosity, five year storage capability, excellent combustion characteristics, low toxicity, low cost, low freezing point, flash point no lower than 60° C., compatibility with common materials, and absence of ionizable compounds. Heating value, viscosity, and cost are primary factors in choosing a fuel for ramjet application. Many proposed high density, high energy fuels have exhibited unacceptable viscosity at typical operating temperatures, with viscosities tending to increase significantly with decrease in temperature. Air launched systems are particularly susceptible to fuel viscosity increases since a missile may be cold soaked at high altitude for a considerable length of time before launch. Operations in cold weather or arctic regions are also threatened by high viscosity fuels for both air and ground launched missiles. It is difficult for fuel systems to deliver high viscosity fuels to the engine, and ignition of the fuel is difficult and uncertain. High viscosity of fuels could lead to unacceptable missile failure rates.

A fuel presently used in missile systems is RJ-4, a synthetic hydrocarbon fuel consisting of a production run mixture of the various isomers of tetrahydrodimethyldicyclopentadiene (THDiMeDCPD). It is known that certain isomers of THDiMeDCPD known as endo-isomers tend to have a significantly higher freezing point and viscosity than other isomers known as exo-isomers. U.S. Pat. No. 4,107,223 to Schneider et al. and references cited therein, the text of which is incorporated by reference herein, recognize this fact and provide for a process to convert endo-THDiMeDCPD to a lower viscosity exo-THDiMeDCPD by treatment with $AlCl_3$ catalyst. The specific isomers employed in the Schneider et al. patent as starting materials are very costly and thus the product is impractical for use as an operational fuel.

SUMMARY OF THE INVENTION

Commercial RJ-4 has been treated according to this invention with a catalyst, preferably with aluminum trichloride ($AlCl_3$) or platinum and preferably at room temperature, to obtain a product fuel having a lower viscosity and freeze point than the original RJ-4. This is thought to be due to isomerization of the endo-THDiMeDCPD isomers to the exo-isomer form.

OBJECTS OF THE INVENTION

One object of this invention is to provide a high density, high energy, low viscosity, liquid hydrocarbon fuel suitable for ramjet applications.

Another object is to provide a method for making a high density, high energy, low viscosity, liquid hydrocarbon fuel by the chemical conversion of an existing fuel of higher viscosity.

Still another object is to provide a method for catalytically treating RJ-4 fuel to isomerize the endo-isomers of THDiMeDCPD contained as a component therein to produce exo-isomers therefrom and thus reduce the viscosity of the overall fuel mixture.

DESCRIPTION OF THE PREFERRED EMBODIMENT

RJ-4 is a commercially available synthetic liquid hydrocarbon fuel presently used in missile systems and is known to consist of a large number of isomers of THDiMeDCPD with varying relative quantities of the various isomers. These isomers have been divided into two classes by structure, i.e., endo-isomers and exo-isomers, and the endo-isomers are known to exhibit a relatively higher freezing point and viscosity than the exo-isomers. Although the prior art has performed isomerization of specific endo-isomers to the exo-isomeric form thus forming a composition having a lower freeze point and viscosity, this product is impractical for independent use as a missile fuel because of the high cost of the starting materials and was proposed as useful only as a missile fuel diluent.

The present invention has made it possible to produce an economical THDiMeDCPD fuel high in exo-isomer content and exhibiting low freeze point and viscosity. The starting material is commercially available RJ-4, a synthetic fuel consisting of a large number of isoners of THDiMeDCPD in varying relative proportions. This material is treated with a catalyst to form the isomerized product fuel, RJ-4-I, a THDiMeDCPD fuel high in the exo-isomer and having substantially lower freeze point and viscosity than the starting material, RJ-4. It is noted that specific batches of commercial RJ-4 may vary significantly in freeze point and viscosity due to variation in isomeric content. Suitable catalysts include aluminum chloride ($AlCl_3$), nickel, and crushed firebrick. The aluminum chloride catalyst is provided in either a suspension with a solvent such as methylene chloride or as an aluminum chloride-olefin complex. The solvent acts to dilute the RJ-4 but also increases reaction rate and is subsequently removed. The firebrick catalyst is provided in an acid treated, pulverized form. The nickel catalyst is disposed on a kieselguhr carrier and is a commercial catalyst. Other metals having known catalytic activity could be employed, however, nickel, due to its low cost, is preferred. The aluminum chloride-olefin complex is prepared by mixing 40–50 wt. percent $AlCl_3$ with a $C_8$ branch chain paraffin and saturating with HCl gas at a temperature of 0° C.–60° C.

The ratio of the amount of catalyst employed to the amount of RJ-4 treated may vary widely, but is preferably such that the isomerization is easily controlled and a product obtained which has the desired freeze point and viscosity without formation of dimethyladamantane, an undesirable product. The mole ratio of $AlCl_3$-olefin complex to the RJ-4 based upon $AlCl_3$ is in the range of about 0.002 to 1 to about 0.5 to 1; a preferable range is between 0.01 to 1 to about 0.02 to 1. A preferred amount of nickel catalyst is about 2 wt. percent nickel based on weight of RJ-4.

The temperature of isomerization must be controlled within a narrow range when employing aluminum chloride catalyst alone or with an inert solvent such as methyl chloride. The lower limit can be influenced by the freezing point of the reaction mixture and/or the rate of the reaction. While the reaction can proceed at a very low temperature the rate could be so slow as to be commercially unattractive. Thus generally the lower temperature limit is about 0° C. with about 10° C. preferred. The upper limit is controlled by the formation of undesirable products which adversely effect the properties of the resulting missile fuel. Also if the reaction rate is too rapid at an elevated temperature an uncontrolled exotherm could result. Thus generally the upper temperature limit is about 100° C. with about 60° C. preferred. The preferred temperature range for isomerization with aluminum chloride-olefin complex is 85°–95° C., although temperatures down to 0° C. can be employed at the expense of very low reaction rates, and temperatures up to 200° C. can be employed. The preferred temperature range for carrying out isomerization with metal catalysts such as nickel and other solids such as crushed firebrick is 220°–245° C.

The pressure when employing aluminum chloride or aluminum chloride-olefin complex catalyst can vary substantially, however, economic consideration will favor a more limited range. Typically, the contacting will occur at atmospheric pressure. However, if a temperature is used which is greater than the boiling point of a solvent, if present, then it is advantageous to use a higher pressure to prevent the solvent from boiling away. The pressure when employing nickel-on-kieselguhr catalyst or firebrick can vary substantially, however, hydrogen pressure of about 30–500 psig. were found preferable. Hydrogen pressures up to 2350 psig. using nickel catalyst were tested and found suitable, although less economical than lower pressures.

To obtain isomerized RJ-4-I product having a density, pour point, and viscosity which make it useful as a high density fuel, the reaction time or contacting time should be sufficient to obtain the desired properties. Sufficient time for use of aluminum chloride catalyst or aluminum chloride-olefin complex catalyst depends in part upon the amount and particular physical and chemical properties of the batch of RJ-4 to be isomerized, the amount of stirring, the amount of catalyst used, the configuration of the vessel containing the reaction or contact mixtures, the temperature of isomerization, the amount of solvent employed, and other variables. Since the amount of isomerization can be monitored during the isomerization by measuring the viscosity, for example, when the desired amount of isomerization has been obtained the reaction can be stopped. Typical reaction times vary from 30 minutes to 15 hours. Similar procedures can be employed to monitor and terminate isomerization when employing nickel or other solids as catalysts. Typical reaction times vary from 10–40 hours.

This invention is more particularly pointed out by the following examples.

EXAMPLE 1

A sample of RJ-4 (TH-dimer) was isomerized in the presence of $AlCl_3$ catalyst in a solvent of methylene chloride. The RJ-4 sample had a density of 0.9212 at 20° C. and a kinematic viscosity of 25.5 at 0° F. and 4.3 at 100° F. Isomerization was carried out at 32° F. for 15 minutes. The resulting RJ-4-I had a density of 0.9110 at 20° C. and a kinematic viscosity of 15.9 at 0° F. and 3.7 at 100° F.

EXAMPLE 2

A sample of THDiMeDCPD (RJ-4) having a density of 0.9216 (20° C.) and viscosity of 4.01 cSt. at 100° F. was treated for 8 minutes at 33°–38° C. with a relatively small amount of aluminum chloride-olefin complex catalyst at atmospheric pressure, the resulting product having a density of 0.9177 and a viscosity of 3.61 cSt. Analysis of the product indicated incomplete isomerization. Treatment of the sample was continued to 30 minutes at a temperature of 33°–43° C., the resulting product having a density of 0.9126 and a viscosity of 3.20 cSt. Analysis of the product of 30 minutes isomerization indicated it contained no adamantanes and the endoisomers had been substantially isomerized to the exo-isomers.

Another sample of THDiMeDCPD (RJ-4) was treated with a relatively small amount of aluminum chloride-olefin complex catalyst at atmospheric pressure. Properties of the sample, treatment conditions, and product properties are listed in Table 1 as follows:

TABLE 1

| Incremental Reaction Time, Hrs. | Temp. °C. | Density $d\frac{20}{4}$ °C. | Kinetic Viscosity 100° F., cst. |
|---|---|---|---|
| 0.0 | — | 0.9212 | 3.33 |
| 3.0 | 33–40 | — | 3.07 |
| 12.0 | 30–58 | — | 2.88 |
| 1.5 | 33–85 | 0.9101 | 2.80 |
| 1.5 | 80–85 | — | 2.88 |
| 1.0 | 80–85 | 0.9103 | 3.00 |

The density and viscosity after 18 hours are seen to increase, probably due to formation and accumulation of adamantanes.

EXAMPLE 3

A sample of methylcyclopentadiene dimer, hydrogenated at low pressure over 10% palladium-on-carbon catalyst (hydrogenated product corresponds to RJ-4), was isomerized in the presence of the hydrogenation catalyst by adding an amount of pulverized, acid-treated common firebrick equal to that of the hydrogen catalyst, raising the temperature to 235°–240° C. and treating under 30–187 psig. hydrogen pressure. After 20 hours the isomerization was not complete, but continuation for an additional 22 hours at 49 psig. hydrogen pressure and a temperature of 245° C. gave an end product having a density of 0.9120 at 20° C., a kinematic viscosity of 2.58 cSt. at 100° F. and 32.4 cSt. at −40° F.

as compared to hydrogenated methylcyclopentadiene dimer without isomerization having a density of 0.9267 at 20° C. and a kinematic viscosity of 4.32 cSt. at 100° F.

EXAMPLE 4

Samples of RJ-4 were isomerized in a one-gallon stirred reactor under hydrogen pressure with commercial Harshaw nickel-on-kieselguhr catalyst. Two wt. percent of nickel based on the RJ-4 weight was employed. The RJ-4 charge material had a density of 0.9254, a freezing point of slightly below 0° F., and a viscosity of 4.00 centistokes at 100° F. Isomerization conditions and results are shown in Table 2. All isomerizates had a freezing point below −80° C. and flowed freely at −80° C.

TABLE 2

| Run No. | Charge | Incremental Reaction Time, Hrs. | Temp. °C. | Pressure psig. | Density $d\frac{20}{4}$ °C. | Viscosity @ 100° F., cst. |
|---|---|---|---|---|---|---|
| 1 | 2500 mls. RJ-4 | 18.5 | 220 | 445 | 0.9166 | 2.89 |
| | 50.0 g Ni-0104P | 3.0 | 232 | 445 | 0.9157 | 2.82 |
| | catalyst | 5.0 | 232 | 465 | 0.9143 | 2.61 |
| 2 | 2600 mls. RJ-4 | 24.0 | 255–260 | 465 | 0.9097 | 2.61 |
| | 63.0 g Ni-0104P catalyst | | | | | |
| 3 | 2600 mls. RJ-4 | 20.0 | 255 | 200 | Small amount of isomerization, not completely isomerized. | |
| | 63.0 g Ni-0104P | 14.0 | 240–245 | 450 | | |
| | catalyst | 14.0 | 255–260 | 450 | 0.9097 | 2.54 |
| 4 | 2800 mls. RJ-4 | 27.0 | 260 | 295 | 0.9069 | 2.45 |
| | 63.0 g Ni-0104P catalyst | | | | | |
| 5 | 2800 mls. RJ-4 | 24.0 | 260 | 465 | — | — |
| | 63.0 g Ni-0104P catalyst | 13.0 | 255 | 360 | 0.9080 | 2.53 |

Hydrogen pressures above 200 psig. appear to be necessary with this catalyst at these temperatures, since isomerization was found to proceed very slowly at 255° C. at 200 psig. in Run No. 3, whereas continuing the same run at 450 psig. of hydrogen for a total of 18 hours without the addition of fresh catalyst resulted in the expected extent of isomerization.

EXAMPLE 5

A sample of THDiMeDCPD having a density of 0.9267 (20° C.) and a kinematic viscosity of 4.32 cSt. at 100° F. was treated with commercial Harshaw nickel-on-kieselguhr catalyst as above at a temperature of 235° C. and a hydrogen pressure of 2350 psig. for 20 hours. The isomerized product had a density of 0.9136 and a viscosity of 2.72 cSt.

In summary, novel methods have been developed to provide a low viscosity, high density, isomerized RJ-4 fuel. Isomerization is accomplished by treating RJ-4 fuel with a catalyst of $AlCl_3$, nickel, or pulverized acid treated firebrick.

Obviously many modifications and variations of the present invention are possible in light of the above teachings. It is therefore to be understood that within the scope of the appended claims the invention may be practiced other than as specifically described.

We claim:

1. A process for making a high density, low viscosity liquid airbreather fuel, isomerized RJ-4, comprising the steps of:

(a) contacting RJ-4, comprising both endo-tetrahydrodimethylidicylopentadiene and exo-tetrahydrodimethyldicyclopentadiene isomers, with a catalyst consisting essentially of an $AlCl_3$-olefin complex; and (b) treating for a sufficient time to obtain isomerized RJ-4 consisting essentially of the exo-tetrahydrodimethyldicyclopentadiene isomer.

2. The process of claim 1 wherein the mole ratio of $AlCl_3$-olefin complex to RJ-4 is in the range of about 0.002 to 1 to about 0.5 to 1 based upon $AlCl_3$.

3. The process of claim 1 wherein the mole ratio of $AlCl_3$-olefin complex to RJ-4 is in the range of about 0.01 to 1 to about 0.02 to 1.

4. The process of claim 1 wherein said treatment step is carried out at temperatures within the range of about 0° C. and about 200° C.

5. The process of claim 1 wherein said treatment step is carried out at temperatures within the range of about 85° C. and about 95° C.

6. The process of claim 1 wherein treatment is carried out for a time period within the range of about 30 minutes to about 15 hours.

7. The process of claim 1 wherein treatment is carried out for a time period which is terminated upon measurement of a predetermined reactant viscosity below that of the RJ-4 feed, said measured viscosity being that of the desired isomerized RJ-4.

* * * * *